US008129907B2

(12) United States Patent
Suzuki et al.

(10) Patent No.: US 8,129,907 B2
(45) Date of Patent: Mar. 6, 2012

(54) PLASMA DISPLAY PANEL

(75) Inventors: Masanori Suzuki, Osaka (JP); Nobutaka Hokazono, Osaka (JP); Kentaro Ueda, Osaka (JP); Toshifumi Nagino, Osaka (JP)

(73) Assignee: Panasonic Corporation, Osaka (JP)

( * ) Notice: Subject to any disclaimer, the term of this patent is extended or adjusted under 35 U.S.C. 154(b) by 272 days.

(21) Appl. No.: 11/817,180

(22) PCT Filed: Dec. 26, 2006

(86) PCT No.: PCT/JP2006/325829

§ 371 (c)(1),
(2), (4) Date: Aug. 27, 2008

(87) PCT Pub. No.: WO2007/077802

PCT Pub. Date: Jul. 12, 2007

(65) Prior Publication Data

US 2009/0212703 A1 Aug. 27, 2009

(30) Foreign Application Priority Data

Dec. 27, 2005 (JP) ..... 2005-374457

(51) Int. Cl.
*H01J 17/49* (2012.01)

(52) U.S. Cl. ..... 313/584; 313/582

(58) Field of Classification Search ..... 313/582–587; 445/24–25

See application file for complete search history.

(56) References Cited

U.S. PATENT DOCUMENTS

| | | | | |
|---|---|---|---|---|
| 5,587,624 | A * | 12/1996 | Komaki | 313/584 |
| 6,433,489 | B1 * | 8/2002 | Tanaka et al. | 315/169.4 |
| 6,566,812 | B1 * | 5/2003 | Torisaki et al. | 313/586 |
| 2003/0090212 | A1 * | 5/2003 | Park et al. | 315/169.1 |
| 2006/0001372 | A1 * | 1/2006 | Park | 313/582 |

FOREIGN PATENT DOCUMENTS

JP 2003-131580 A 5/2003

* cited by examiner

*Primary Examiner* — Karabi Guharay
*Assistant Examiner* — Elmito Breval
(74) *Attorney, Agent, or Firm* — RatnerPrestia

(57) ABSTRACT

The plasma display panel includes: a front panel having a front substrate and display electrodes; and a rear panel having a rear substrate, a barrier rib, a data electrode and a phosphor layer. The rear substrate faces the front substrate to form a discharge space therebetween. The barrier rib is disposed on the rear substrate to divide the discharge space. The data electrode intersects the display electrodes. The phosphor layer is disposed between the barrier ribs. Further, the display electrodes are formed at a plurality of divided areas separately. The plurality of divided areas is the areas that the front substrate is divided into by a boundary intersecting the display electrodes. The display electrodes formed in the plurality of divided areas have unevenesses in profiles thereof at the boundary between the plurality of divided areas. This configuration easily provides a plasma display panel having a large screen and high resolution as display quality.

9 Claims, 10 Drawing Sheets

PLASMA DISPLAY PANEL

This application is a U.S. National Phase Application of PCT International Application PCT/JP2006/325829, filed Dec. 26, 2006.

TECHNICAL FIELD

The present invention relates to a plasma display panel used as a display device of a plasma display apparatus.

BACKGROUND ART

Conventional plasma display panels used in plasma display apparatuses are divided broadly into an AC type and a DC type, different in driving mode. The plasma display panels are further divided into a surface discharge type and an opposing discharge type, different in discharge mode. In recent years, a dominating plasma display panel has been the 3-electrode surface discharge type one, because of its suitability for high resolution and for a large screen and of its easy fabrication.

The surface discharge type plasma display panel has a pair of substrates placed oppositely so as to form a discharge space therebetween. At least the front one of the substrates is transparent. Further, a barrier rib for dividing the discharge space into a plurality of spaces is disposed on the substrate. Each of the substrates has a group of electrodes disposed thereon so that discharges occur within the discharge spaces divided by the barrier rib. Phosphors for generating light of red, green and blue colors are disposed on the discharge spaces, and thereby the discharge spaces form a plurality of discharge cells. The phosphors are excited by vacuum ultraviolet light with short wave length generated by the discharge, so that the discharge cells having phosphors responsible for red, green and blue colors generate visible light of respective colors. Thus, the plasma display panel implements a full color display.

The plasma display panels have many advantages including their capability of high-speed display, a wider viewing angle, adaptability for upsizing, and higher display quality because of their self-luminous function, as compared to liquid crystal display panels. These features thus gain attention especially in recent years among various flat-panel displays, and many plasma display panels are used for a variety of purposes such as displays in public places where many people gather, and displays in private homes for family members to enjoy images on large screens.

In the conventional plasma display apparatus, the plasma display panel is secured to a front surface of a chassis base, and a circuit board is mounted to the backside of the chassis base. Thus, a module is formed. The plasma display panel includes glass as chief material, whereas the chassis base is made of metal, such as aluminum. A circuit board constitutes a driving circuit for lighting the plasma display panel. The conventional plasma display panel and the plasma display apparatus having the same therein are disclosed in Unexamined Japanese Patent Publication No. 2003-131580 (Patent Document 1) and others.

Patent Document 1: Unexamined Japanese Patent Publication No. 2003-131580.

DISCLOSURE OF THE INVENTION

The present invention provides a plasma display panel advantageously requiring no supersized manufacturing equipment, being low in manufacturing costs, maintaining a high manufacturing yield, and being suitable for a large screen and high resolution.

The plasma display panel of the present invention includes: a front panel having a front substrate and display electrodes; and a rear panel having a rear substrate, a barrier rib, a data electrode and a phosphor layer. The rear substrate faces the front substrate to form a discharge space therebetween. The barrier rib is disposed on the rear substrate to divide the discharge space. The data electrode intersects the display electrodes. The phosphor layer is disposed between the barrier ribs. Further, the display electrodes are formed at a plurality of divided areas separately. The plurality of divided areas is the areas that the front substrate is divided into by a boundary intersecting the display electrodes. The display electrodes formed in the plurality of divided areas have unevenesses in profiles thereof at the boundary between the plurality of divided areas. This configuration easily provides a plasma display panel having a large screen and high resolution as display quality.

REFERENCE MARKS IN THE DRAWINGS

Figure 1:
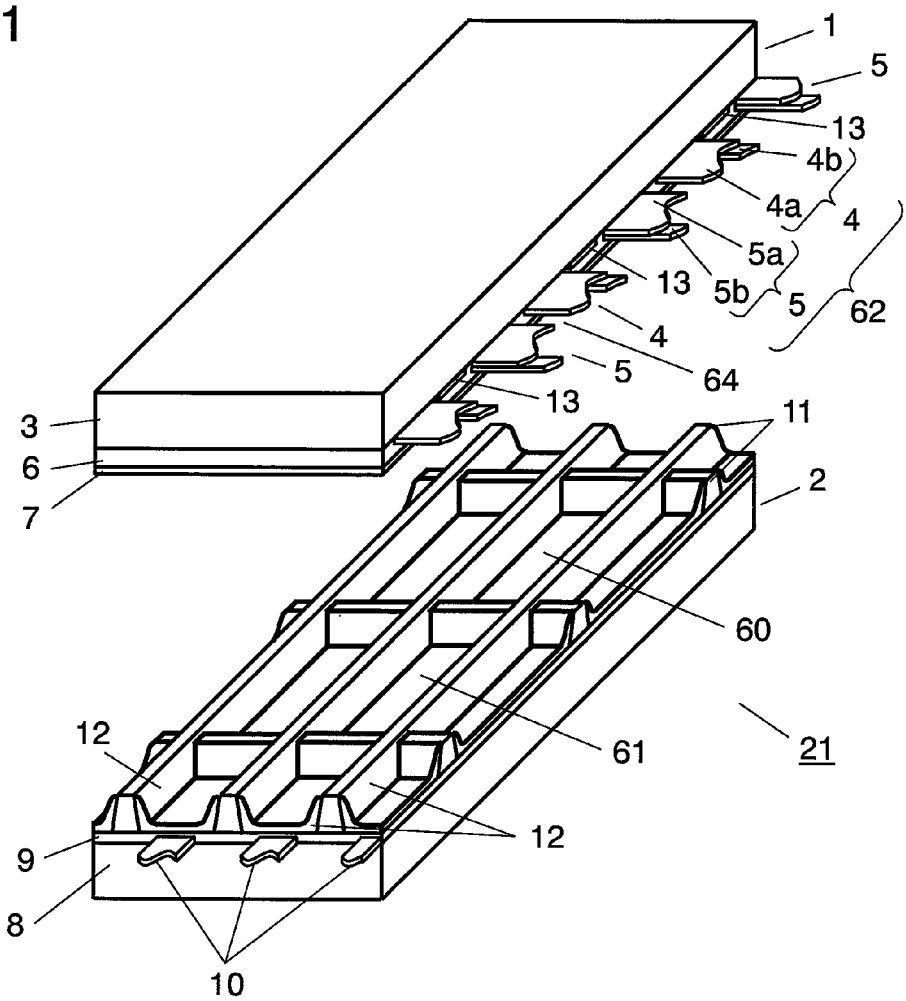
FIG. 1 is a schematic perspective view showing an essential part of a plasma display panel according to an exemplary embodiment of the present invention.

1 front panel
1*a* and 2*a* alignment mark
1*b* and 2*b* boundary
1*c* recess
2 rear panel
3 front substrate
4 scan electrode
4*a* and 5*a* transparent electrode
4*b* and 5*b* bus electrode
5 sustain electrode
6 dielectric layer
7 protective layer
8 rear substrate
9 insulating layer
10 data electrode
11 barrier rib
12 phosphor layer
13 light-shielding layer
21 plasma display panel
60 discharge space
61 discharge cell
62 display electrode
63 plasma display apparatus

PREFERRED EMBODIMENTS FOR CARRYING OUT OF THE INVENTION

A plasma display panel according to an embodiment of the present invention is described hereinafter with reference to FIGS. 1 to 12. The present invention is, however, not restricted to the following description.

First, the structure of the plasma display panel will be described with reference to FIG. 1. As shown in FIG. 1, plasma display panel 21 (herein after referred to as panel 21) has front panel 1 and rear panel 2 oppositely disposed so as to form discharge space 60 therebetween. Front panel 1 and rear panel 2 are sealed with each other by use of sealant (not shown) disposed on their peripherals. Discharge space 60 is filled with discharge gas. Thus, panel 21 is formed. A glass frit is used as the sealant, for example. Mixed gas of neon and xenon is used as the discharge gas, for example.

Front panel 1 includes front substrate 3 made of glass, and a plurality of display electrodes 62 arranged in parallel with each other on front substrate 3. Display electrode 62 has scan electrode 4 as the first electrode and sustain electrode 5 as the second electrode. A pair of scan electrode 4 and sustain electrode 5 are arranged in parallel so as to oppose each other with discharge gap 64 therebetween. Further, scan electrode 4 and sustain electrode 5 are covered with dielectric layer 6 made of glass. On dielectric layer 6, protective layer 7 made of MgO is formed. Thus, front panel 1 is configured. Scan electrode 4 has transparent electrode 4*a* and bus electrode 4*b* stacked on transparent electrode 4*a*. Likewise, sustain electrode 5 has transparent electrode 5*a* and bus electrode 5*b* stacked on transparent electrode 5*a*. Transparent electrodes 4*a* and 5*a* are each formed of ITO or the like and are optically transparent. Bus electrodes 4*b* and 5*b* each contain electrically conductive material, such as Ag, as a major constituent.

Back panel 2 includes rear substrate 8 which is made of glass and is facing front substrate 3, and a plurality of data electrodes 10 disposed on rear substrate 8. Data electrode 10 is made of electrically conductive material, such as Ag. Data electrode 10 is covered with insulating layer 9 made of glass. Further, barrier rib 11 is arranged on insulating layer 9 in a lattice form. Barrier rib 11 divides discharge space 60 into discharge cells 61. Phosphor layers 12 responsible for red, green and blue colors are disposed between barrier ribs 11. Thus, rear panel 2 is configured. Data electrode 10 is arranged between barrier ribs 11 so as to intersect scan electrode 4 and sustain electrode 5. This configuration forms discharge cells 61 at the intersections of scan electrodes 4 and sustain electrodes 5 with data electrodes 10. Discharge cells 61 are divided by barrier ribs 11.

Black light-shielding layers 13 having a high light-shielding effect are provided to improve contrast. Each light-shielding layer 13 is arranged between scan electrode 4 and sustain electrode 5.

The structure of panel 21 is not restricted to the structure described above. For example, panel 21 may have barrier ribs being in a stripe form. In terms of the arrangement of scan electrodes 4 and sustain electrodes 5, FIG. 1 shows display electrodes 62 having scan electrodes 4 and sustain electrodes 5 arranged alternately, in the order of scan electrode 4, sustain electrode 5, scan electrode 4, sustain electrode 5, and so on. Panel 21 may, however, have display electrode 62 having scan electrodes 4 and sustain electrodes 5 arranged in the order of scan electrode 4, sustain electrode 5, sustain electrode 5, scan electrode 4, and so on.

Figure 2:
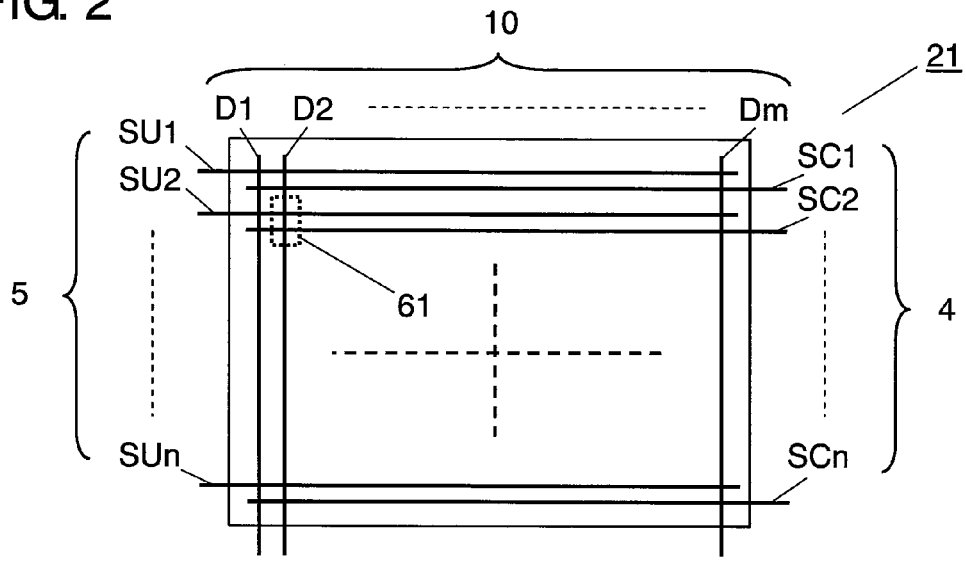
FIG. 2 is a schematic view showing an arrangement of electrodes in the plasma display panel shown in FIG. 1.

FIG. 2 is a schematic view showing an arrangement of the electrodes in the plasma display panel shown in FIG. 1. In a direction of columns (i.e., vertically in FIG. 2), n scan electrodes 4, i.e., scan electrodes SC1 to SCn, and n sustain electrodes 5, i.e., sustain electrodes SU1 to SUn are arranged. On the other hand, in a direction of rows (i.e., horizontally in FIG. 2), m data electrodes 10, i.e., data electrodes D1 to Dm are arranged. Each discharge cell 61 is formed at the intersection of a pair of scan electrode SCi and sustain electrode SUi (where, "i" takes any of 1 to n) and data electrode Dj (where, "j" takes any of 1 to m). Thus, m×n discharge cells 61 are formed within discharge space 60.

Figure 3:
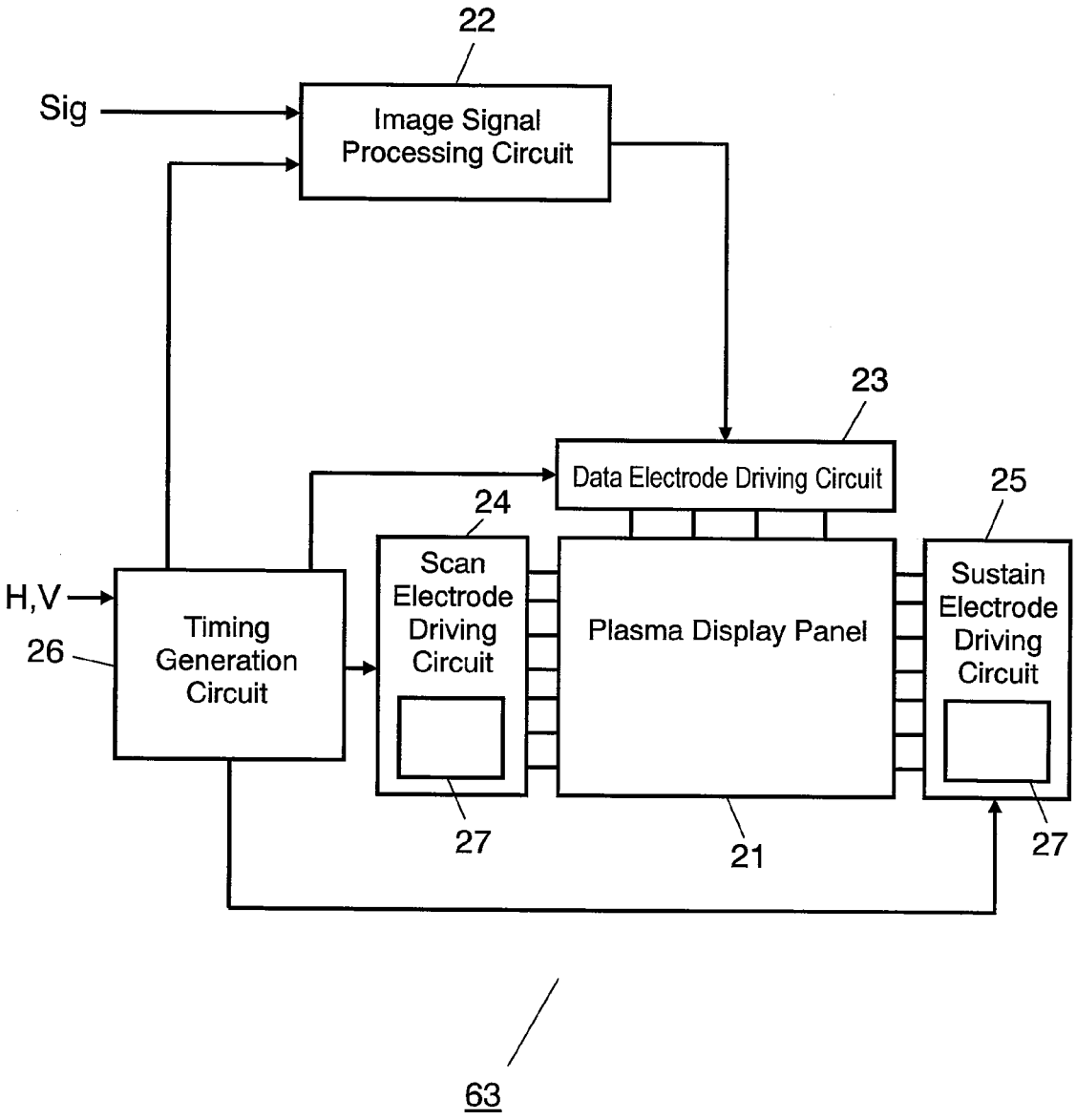
FIG. 3 is a circuit block diagram of a plasma display apparatus provided with the plasma display panel shown in FIG. 1.

FIG. 3 is a circuit block diagram of the plasma display apparatus provided with plasma display panel 21. Plasma display apparatus 63 includes panel 21, image signal processing circuit 22, data electrode driving circuit 23, scan electrode driving circuit 24, sustain electrode driving circuit 25, timing generation circuit 26, power source circuit (not shown), and others.

In FIG. 3, timing generation circuit 26 generates various timing signals according to horizontal synchronizing signal H and vertical synchronizing signal V, and feeds the generated signals into respective driving circuit blocks, i.e., image signal processing circuit 22, data electrode driving circuit 23, scan electrode driving circuit 24 and sustain electrode driving circuit 25. Image signal processing circuit 22 converts image signal Sig into image data corresponding to respective sub-fields. Data electrode driving circuit 23 converts the image data corresponding to each sub-field into signals corresponding to respective data electrodes D1 to Dm. Respective data electrodes D1 to Dm are driven by the signals converted by data electrode driving circuit 23. Scan electrode driving circuit 24 provides scan electrodes SC1 to SCn with driving voltage waveforms according to the timing signal fed by timing generation circuit 26. Likewise, sustain electrode driving circuit 25 provides sustain electrodes SU1 to SUn with driving voltage waveforms according to the timing signal fed by timing generation circuit 26. Scan electrode driving circuit 24 and sustain electrode driving circuit 25 each include sustain pulse generator 27.

Figure 4:
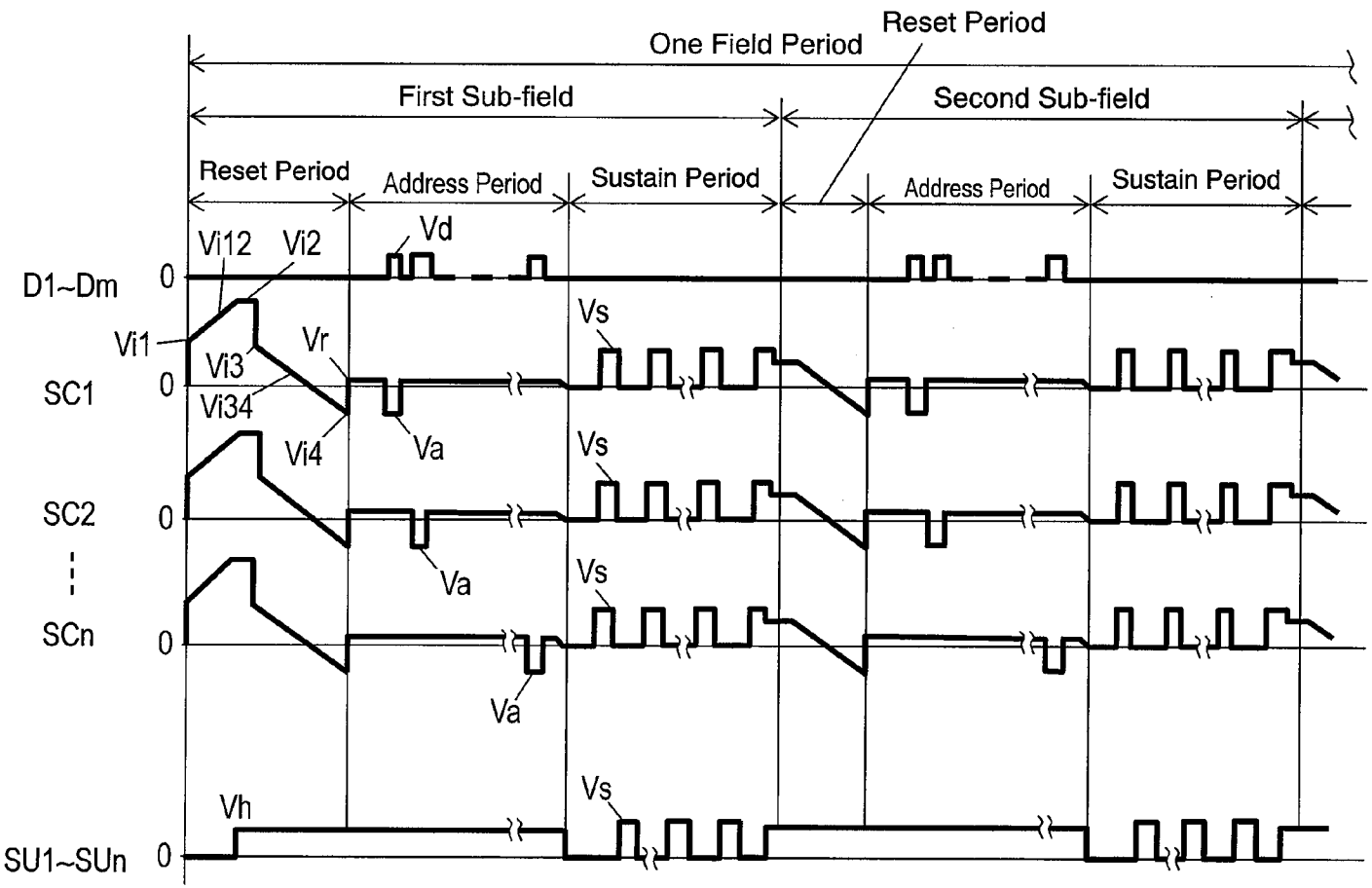
FIG. 4 is a waveform chart showing driving voltage waveforms for driving the plasma display apparatus shown in FIG. 3.

Next, driving voltage waveforms for driving plasma display panel 21 and an operation of panel 21 will be described with reference to FIG. 4. FIG. 4 shows driving voltage waveforms applied to respective electrodes in the plasma display panel.

In the operation of plasma display apparatus 63, one display field is divided into a plurality of sub-fields; each subfield has a reset, address, and sustain period.

In the reset period within the first sub-field, data electrodes D1 to Dm and sustain electrodes SU1 to SUn are initially kept at 0 (V); meanwhile, ramp voltage Vi12 is applied to scan electrodes SC1 to SCn. Ramp voltage Vi12 mildly increases from voltage Vi1 (V) not higher than the discharge starting voltage, up to voltage Vi2 (V) higher than the discharge starting voltage. During this process, a minor first-time reset discharge occurs at all of discharge cells 61. As a result, a negative wall voltage builds up on scan electrodes SC1 to SCn, while a positive wall voltage builds up on sustain electrodes SU1 to SUn and data electrodes D1 to Dm. The wall voltage on electrodes represents a voltage generated by the wall charges accumulated on dielectric layer 6 or phosphor layer 12, which are disposed over the electrodes.

Thereafter, sustain electrodes SU1 to SUn are maintained at positive voltage Vh (V); meanwhile, a ramp voltage Vi34 is applied to scan electrodes SC1 to SCn. Ramp voltage Vi34 mildly decreases from voltage Vi3 (V) to voltage Vi4 (V). During this process, a minor second-time reset discharge occurs at all of discharge cells 61. As a result, the wall voltages on scan electrodes SC1 to SCn and sustain electrodes SU1 to SUn are lessened, and the wall voltage on data electrodes D1 to Dm is properly controlled for the addressing.

In the address period within the first sub-field, firstly, scan electrodes SC1 to SCn are maintained at voltage Vr (V). Next, negative scan pulse voltage Va (V) is applied to scan electrode SC1 located at the first row; meanwhile, positive address pulse voltage Vd (V) is applied to data electrode Dk (where, "k" takes any of 1 to m) among data electrodes D1 to Dm. Data electrode Dk corresponds to discharge cell 61 that is to show the image signal on the first row. At the intersection of data electrode Dk and scan electrode SC1, the wall voltage on data electrode Dk and the wall voltage on scan electrode SC1 are added to externally applied voltage (Vd−Va) (V). Consequently, the voltage at the intersection exceeds the discharge starting voltage, so that an address discharge occurs between data electrode Dk and scan electrode SC1, and also between sustain electrode SU1 and scan electrode SCi. This address discharge causes the positive wall voltage to build up on scan electrode SC1, the negative wall voltage on sustain electrode SU1, and the negative wall voltage on data electrode Dk at discharge cell 61 that has undergone the address discharge.

In this way, some of discharge cells 61 that are to show the image signal on the first row undergo the address discharge, so that the wall voltages build up on the respective electrodes. Thus, an address operation for those discharge cells 61 is performed. On the other hand, the voltage does not exceed the discharge starting voltage at the intersection of some of data electrodes D1 to Dm that the address pulse voltage Vd (V) is not applied to and scan electrode SC1, and therefore, does not cause the address discharge. In the same manner, the addressing operation is performed raw-by-raw. When discharge cells 61 on the last row are addressed, the address period within the first sub-field is completed.

Next, in the sustain period within the first sub-field, positive sustain pulse voltage Vs (V) as the first voltage is applied to scan electrodes SC1 to SCn, and meanwhile, the ground voltage, i.e., 0 (V) as the second voltage is applied to sustain electrodes SU1 to SUn. At discharge cell 61 that has undergone the address discharge during the address period, sustain pulse voltage Vs (V) is added to each wall voltage on scan electrode SCi and sustain electrode SUi; consequently, the voltage between the voltage on scan electrode SCi and the voltage on sustain electrode SUi exceeds the discharge starting voltage. As a result, the sustain discharge occurs between scan electrode SCi and sustain electrode SUi, and ultraviolet light generated by the sustain discharge excites phosphor layer 12 to generate visible light. Further, the sustain discharge causes the negative wall voltage to build up on scan electrode SCi and the positive wall voltage on sustain electrode SUi and data electrode Dk.

At discharge cell 61 that underwent no address discharge during the address period, no sustain discharge occurs, so that the wall voltage at the end of the reset period is maintained. Following the sustain discharge, 0 (V) as the second voltage is applied to scan electrodes SC1 to SCn; meanwhile, sustain pulse voltage Vs (V) as the first voltage is applied to sustain electrodes SU1 to SUn. As a result, the voltage between sustain electrode SUi and scan electrode SCi exceeds the discharge starting voltage at discharge cell 61 that previously underwent the sustain discharge, causing the sustain discharge between sustain electrode SUi and scan electrode SCi again. This sustain discharge causes the negative wall voltage to build up on sustain electrode SUi and the positive wall voltage on scan electrode SCi.

Thereafter, sustain pulse voltage Vs (V) is, in the same manner, alternately applied to scan electrodes SC1 to SCn and sustain electrodes SU1 to SUn. The number of applying sustain pulse voltage Vs (V) is weighed by luminance. In this way, the sustain discharge occurs successively at discharge cell 61 that underwent the address discharge during the address period. Thus, the sustain operation during the sustain period is completed.

In the second sub-field following the first one, the operations during the reset, address and sustain periods are generally the same as those in the first sub-field. Further, the operations in the third and later sub-fields are also generally the same. Therefore, description is omitted on the operations in the second and later sub-fields.

Figure 5:
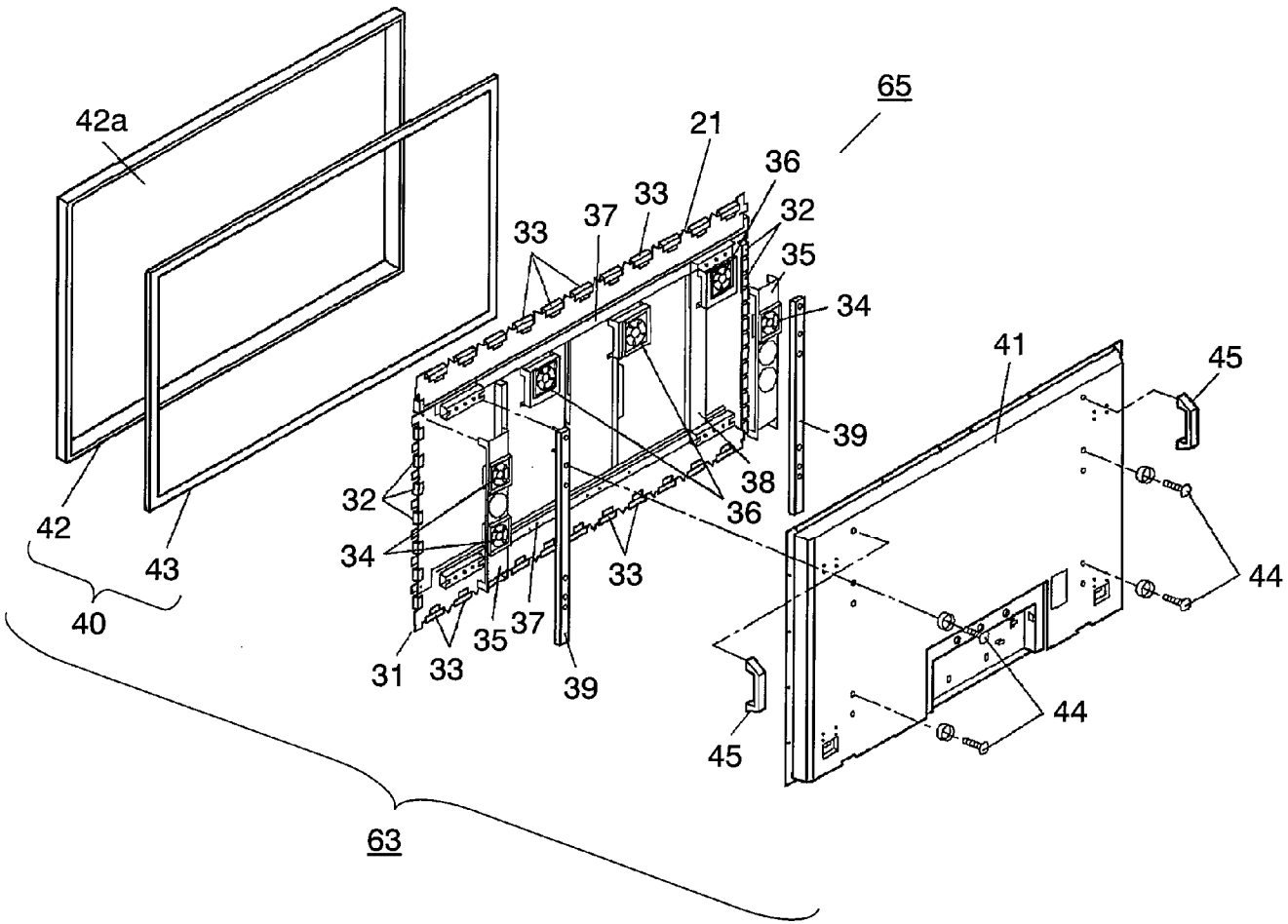
FIG. 5 is an exploded perspective view schematically showing an overall structure of the plasma display apparatus provided with the plasma display panel shown in FIG. 1.

Next, description will be given with reference to FIG. 5 on an overall structure of plasma display apparatus 63 in which plasma display panel 21 is built in. FIG. 5 is an exploded perspective view schematically showing the overall structure of the plasma display apparatus provided with the plasma display panel of the present invention.

In FIG. 5, chassis base 31, made of metal, such as aluminum, serves both as a holder plate and a heat sink plate. Panel 21 is held on a front side of chassis base 31. Panel 21 and chassis base 31 are bonded by use of an adhesive (not shown) or the like with a heat sink sheet (not shown) interposed therebetween. A plurality of driving circuit blocks (not shown) are disposed on a back side of chassis base 31. The driving circuit blocks drive plasma display panel 21 to show the image. Module 65 is thus configured. In FIG. 5, panel 21, being behind chassis base 31, is not shown.

The heat sink sheet is provided so as for panel 21 to keep close contact with and be held on the front side of chassis base 31, and thereby conducts and dissipates the heat generated by panel 21 to chassis base 31. The heat sink sheet is about 1 mm to 2 mm in thickness, for example. The heat sink sheet is formed of an electrically insulative sheet composed of synthetic resin, such as acryl resin, polyurethane resin, silicone resin and silicone rubber, with filler contained therein to improve heat conductivity. The heat sink sheet may instead be formed of a graphite sheet or a metal sheet. Further, the heat sink sheet itself may have adhesivity so as for panel 21 to be bonded with and held by chassis base 31 without adhesive. Alternatively, the heat sink sheet having no adhesivity may bond panel 21 and chassis base 31 via a double-sided adhesive tape.

Around both side edges of panel 21, are there disposed flexible wiring sheets 32 as display electrode wiring components that are connected with leading conductors of scan electrodes 4 and sustain electrodes 5. Flexible wiring sheets 32 extend over an outer periphery of chassis base 31 to the back side thereof, and are connected with a driving circuit block (not shown) corresponding to scan electrode driving circuit 24 and a driving circuit block (not shown) corresponding to sustain electrode driving circuit 25 via respective connectors.

On the other hand, around a top edge and a bottom edge of panel 21, are there disposed a plurality of flexible wiring sheets 33 as data electrode wiring components that are connected with leading conductors of data electrodes 10. Flexible wiring sheets 33 are electrically connected with a plurality of data drivers in data electrode driving circuit 23. Flexible wiring sheets 33 also extend over the outer periphery of chassis base 31 to the back side thereof, and are electrically connected with driving circuit blocks (not shown) in data electrode driving circuit 23. The driving circuit blocks in data electrode driving circuit 23 are disposed at an upper position and a lower position on the back side of chassis base 31.

In the vicinity of the respective driving circuit blocks, cooling fans 34, supported by angle frames 35, are arranged. Air flows from cooling fans 34 cool the respective driving circuit blocks. At the upper position of chassis base 31, three cooling fans 36 are arranged. Cooling fans 36 cool the driving circuit block in data electrode driving circuit 23 that is disposed at the upper position of chassis base 31. Cooling fans 36 also generate an air flow running through the entire internal space of plasma display apparatus 63 from the bottom to the top along the back side of chassis base 31. This air flow cools an interior of plasma display apparatus 63.

Further, on chassis base 31, horizontal angle frames 37 and vertical angle frames 38 are secured for mechanical reinforcement. On angle frames 37, stand poles 39 are rigidly mounted by use of machine screws (not shown) to hold plasma display apparatus 63 standing upright.

Module 65, with the structure described above, is housed in an enclosure having front protection cover 40 placed on the front side of panel 21 and metal back cover 41 placed on the back side of chassis base 31. Thus, plasma display apparatus 63 is completed. Front protection cover 40 has front frame 42 and protection plate 43. Front frame 42 has opening 42*a*, and is composed of resin, metal or the like. Opening 42*a* is provided to expose an image display area on the front side of panel 21. Protection plate 43, made of glass or the like and optically transparent, is provided in opening 42*a*. Protection plate 43 is, for example, provided with an electromagnetic interference suppression film or an optical filter to suppress undesired emission of electromagnetic waves. Protection plate 43 is mounted inside front frame 42 with the periphery of protection plate 43 held by protection plate clamps (not shown) and the periphery of opening 42*a*. Besides, back cover 41 is provided with a plurality of vent openings (not shown) for dissipating heat generated by module 65.

As shown in FIG. 5, back cover 41 is secured to chassis base 31 by use of mechanical screws 44. On back cover 41, handles 45 are secured by use of mechanical screws (not shown) or the like. Handles 45 are used to carry plasma display apparatus 63.

Next, description will be given on the characteristics of the present invention to implement plasma display panel 21 having a large screen.

Use of exposure and development processes are effective to form the components, such as scan electrode 4, sustain electrode 5, data electrode 10, light-shielding layer 13 and barrier rib 11, on panel 21 in high precision. First, a photosensitive layer is formed on a substrate. Then the photosensitive layer is exposed to light via a photomask that allows a predetermined pattern to be drawn on. After being exposed, the photosensitive layer is developed. This development forms a highly precise pattern on the substrate. The advancing growth in screen size of the plasma display panel has, however, come to require such a large-sized plasma display panel that a broader area has to be exposed to light than an exposure area covered by an ordinary exposure device. To expose such a large-sized plasma display panel to light, a divisional exposing method is effective. The method divides the exposure area into a plurality of sub-areas and exposes the sub-areas to light one-by-one.

FIGS. 6A to 6D show the divisional exposure method used for easily manufacturing panel 21 of the present invention having a large screen. The figures specifically show the exposure method that exposes photosensitive layer 52 coated on substrate 51 to light via photomask 53.

Figure 6A:
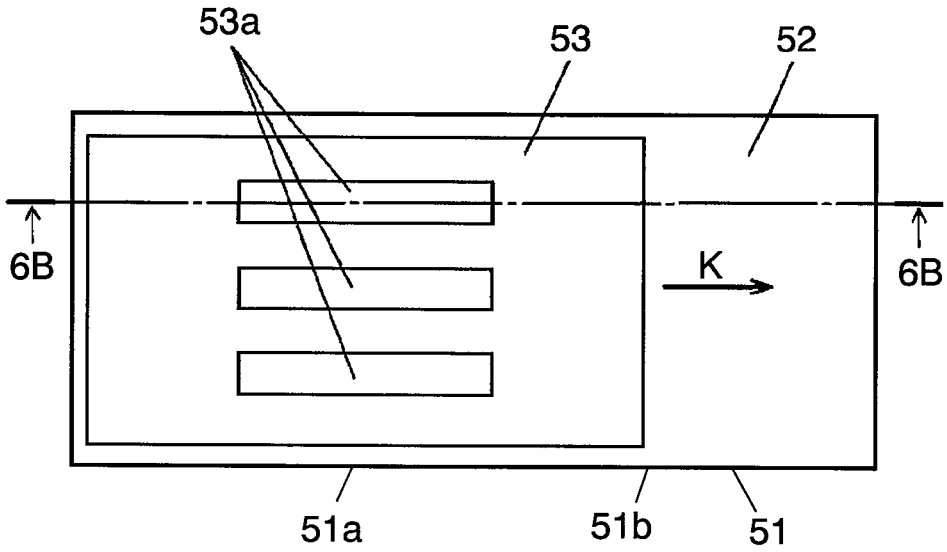
FIG. 6A is an explanatory view showing a divisional exposure method used for manufacturing the plasma display panel shown in FIG. 1.
Figure 6B:
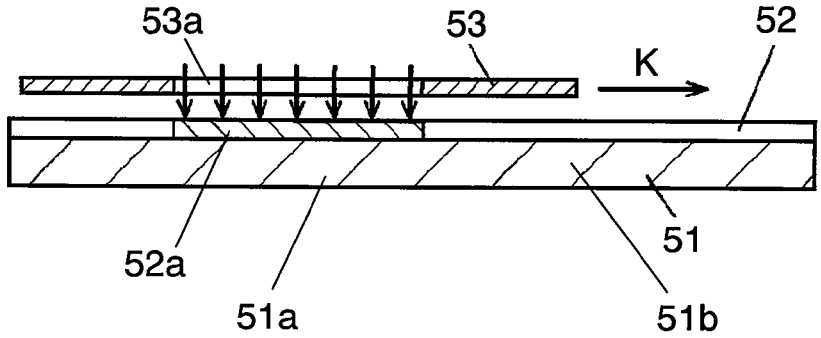
FIG. 6B is a schematic cross-sectional view showing the plasma display panel shown in FIG. 6A taken from line 6B-6B.
Figure 6C:
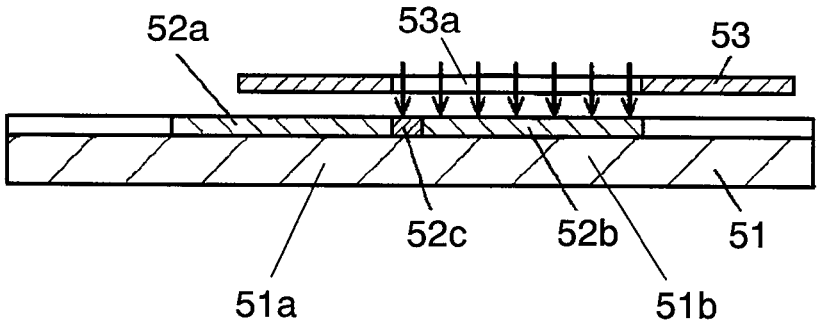
FIG. 6C is a schematic cross-sectional view showing the plasma display panel shown in FIG. 6A.
Figure 6D:
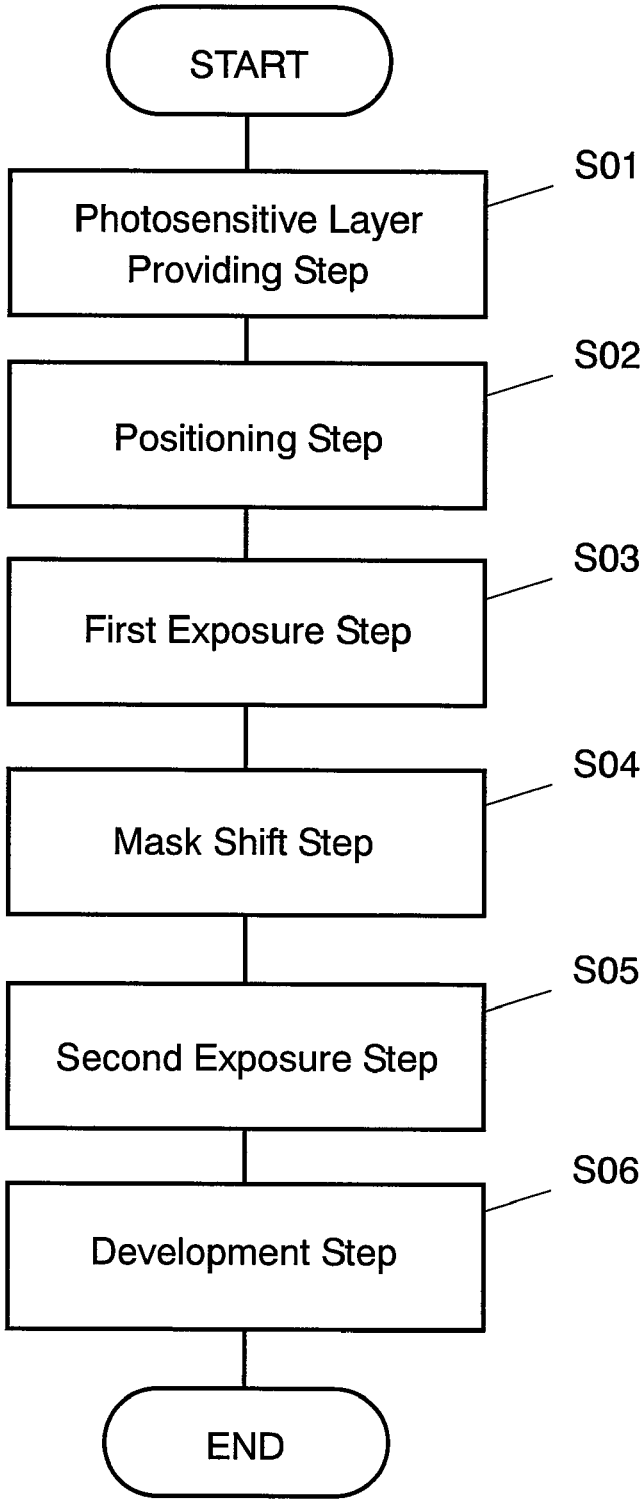
FIG. 6D is a flowchart showing a manufacturing method of the plasma display panel shown in FIG. 1.

FIG. 6A is a schematic plan view showing substrate 51, a left area of which is undergoing exposure to light. FIG. 6B is a schematic cross-sectional view showing substrate 51 taken from line 6B-6B of FIG. 6A. FIG. 6C is a schematic cross-sectional view showing substrate 51, a right area of which is undergoing exposure to light. Further, FIG. 6D is a flowchart showing steps of exposing and developing substrate 51.

First, at photosensitive layer providing step SOI, photosensitive layer 52, made of silver paste or the like for forming a component of plasma display panel 21, is provided on substrate 51.

Next, at positioning step S02, substrate 51 having photosensitive layer 52 is positioned in relation to the exposure device (not shown).

At first exposure step S03, photosensitive layer 52 on left area 51*a* of substrate 51 is exposed to light by a light source (not shown) provided above photomask 53. During this exposure, photomask 53 is placed over left area 51*a* of substrate 51 at a preset height from photo sensitive layer 52. Photomask 53 is provided with opening 53*a*, and thereby allows the left area of photosensitive layer 52 to be selectively exposed in left exposure pattern 52*a*.

Further, at mask shift step S04, photomask 53 is shifted and placed over right area 51*b* of substrate 51 at the preset height from photosensitive layer 52.

At second exposure step S05, photosensitive layer 52 on right area 51*b* of substrate 51 is exposed to light by the light source provided above photomask 53, so that the right area of photosensitive layer 52 is selectively exposed in right exposure pattern 52*b*.

Moreover, at development step S06, photosensitive layer 52 exposed to light is developed, and thereby, an unexposed area in photosensitive layer 52 is removed so that components having predetermined patterns, such as patterned electrodes, are formed.

That is, since substrate 51 is sufficiently larger than photomask 53, substrate 51 is divided into two exposure areas as shown in FIG. 6A. The two exposure areas are exposed to light one-by-one with photomask 53 shifted in direction of arrow K, so that the entire area of substrate 51 is exposed. More specifically, substrate 51 undergoes the divisional exposure, which is divided into two steps: a step of exposing left area 51*a* of substrate 51 as shown in FIG. 6B, and a step of exposing right area 51*b* of substrate 51 as shown in FIG. 6C. Photomask 53 is provided with opening 53*a* to form the patterned electrodes and the like of the plasma display panel. Photosensitive layer 52 is exposed to light by the light source provided above photomask 53 via opening 53*a*. Linking portion 52*c* is twice exposed to light, i.e., at first exposure step S03 and at second exposure step S05. While left area 51*a* is exposed at first exposure step S03, right area 51*b* is shielded with a shield plate (not shown). Likewise, while right area 51*b* is exposed at second exposure step S05, left area 51*a* is shielded with the shield plate.

The divisional exposure method shown in FIGS. 6A to 6D relates a method of exposing left area 51*a* and right area 51*b* of substrate 51 separately by use of single photomask 53. Photomask 53 used for the divisional exposure of substrate 51 is, however, not necessarily single. For example, two different photomasks can be used: a left area photomask for exposing left area 51*a* and a right area photomask for exposing right area 51*b*.

The flowchart shown in FIG. 6D includes neither a step of drying photosensitive layer 52 nor a step of baking the same. The method is, however, not restricted to the flowchart shown in FIG. 6D. The method may rather include any step adequate to manufacture the plasma display panel, such as the drying step or the baking step.

When front panel 1 is manufactured, front substrate 3 is provided as substrate 51. Besides, when scan electrode 4 and sustain electrode 5 are formed as the components, material for composing scan electrode 4 and sustain electrode 5 is provided on front substrate 3 as photosensitive layer 52. When light-shielding layer 13 is formed as the component, material for composing light-shielding layer 13 is provided on front substrate 3 as photosensitive layer 52. Likewise, when rear panel 2 is manufactured, rear substrate 8 is provided as substrate 51. Besides, when data electrode 10 are formed as the components, material for composing data electrode 10 is provided on rear substrate 8 as photosensitive layer 52. When barrier rib 11 is formed as the component, material for composing barrier rib 11 is provided on rear substrate 8 as photosensitive layer 52.

Figure 7A:
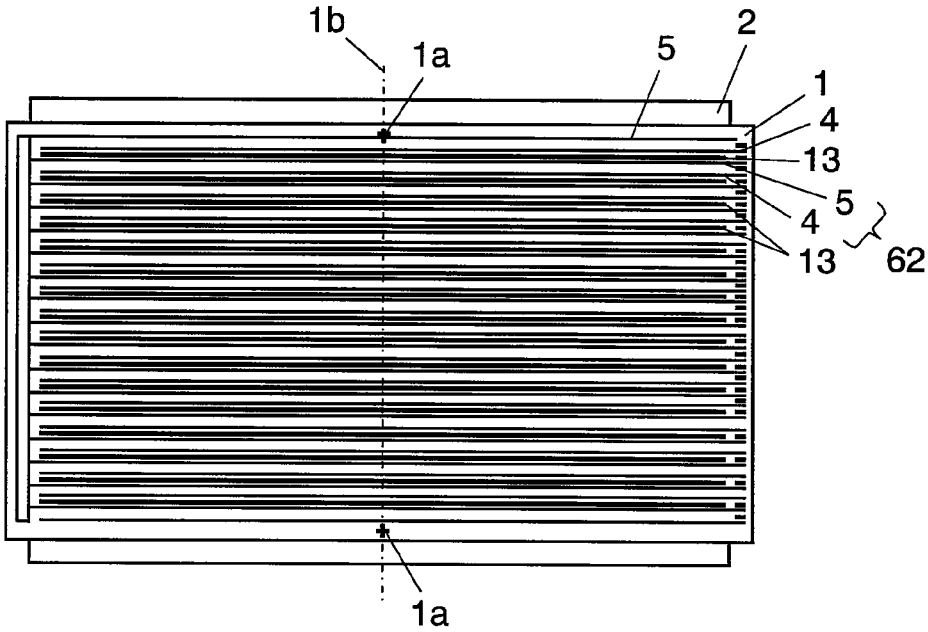
FIG. 7A is a schematic plan view showing the plasma display panel shown in FIG. 1 viewed from its front panel.
Figure 7B:
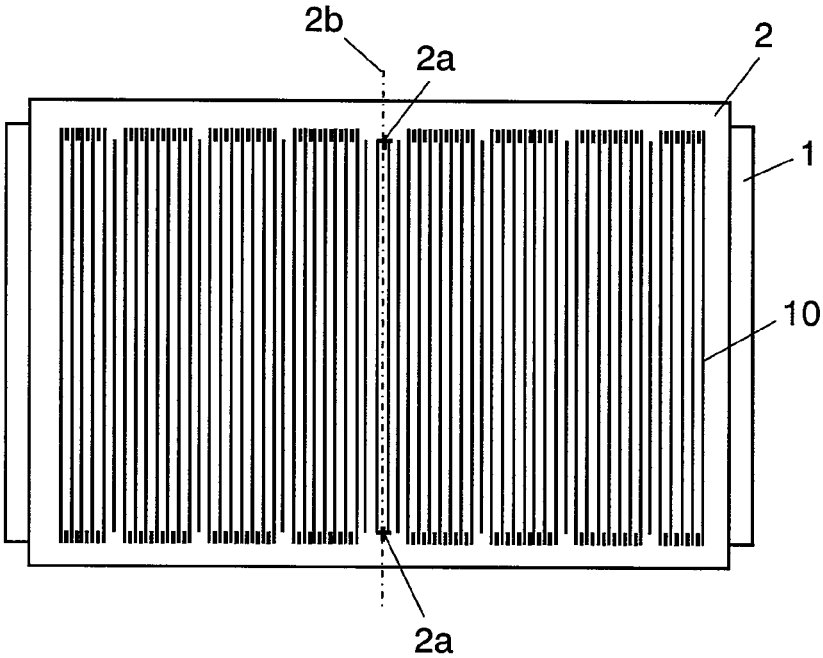
FIG. 7B is a schematic plan view showing the plasma display panel shown in FIG. 1 viewed from its rear panel.

Next, FIG. 7A is a schematic plan view showing plasma display panel 21 viewed from front panel 1, where the plasma display panel 21 has the components formed by use of the divisional exposure method described above. FIG. 7B is a schematic plan view showing plasma display panel 21 viewed from rear panel 2.

As shown in FIG. 7A, cross-shaped alignment marks 1*a* are provided on front panel 1 at respective centers of a top edge portion and a bottom edge portion around a long side of front panel 1. Likewise, as shown in FIG. 7B, cross-shaped alignment marks 2*a* are provided on rear panel 2 at respective centers of a top edge portion and a bottom edge portion around a long side of rear panel 2. When the divisional exposure method is performed as shown in FIGS. 6A to 6D, alignment marks 1*a* and 2*a* are used to align front substrate 3 or rear substrate 8 as substrate 51 with photomask 53.

Alignment marks 1*a* may be formed of ITO on front substrate 3 simultaneously with transparent electrodes 4*a* and 5*a*. Likewise, alignment marks 2*a* may be formed of electrically conductive material, such as Ag, on rear substrate 8 simultaneously with data electrode 10.

As describe above, alignment marks 1*a* and 2*a* are provided at the respective centers of the top and bottom edge portions around the long sides of both front panel 1 and rear panel 2. Alignment marks 1*a* and 2*a* are used to align substrate 51 with photomask 53 in the steps of the divisional exposure method shown in FIGS. 6A to 6D. The components of plasma display panel 21 are, thereby, allowed to be exposed to light separately in respective divided areas so that the components are formed precisely. This results in plasma display panel 21 that maintains high display quality over a certain level in the respective divided areas. As a result, plasma display panel 21 having a large screen and high resolution, and plasma display apparatus 63 having the same therein are easily provided. Therefore, plasma display apparatuses 63 having a screen as large as 65 inches or more and also having high resolution as display quality (i.e., 1080×1920 or more) have been manufactured easily and at low costs, especially in recent years. In other words, there have been provided a plasma display panel 21 requiring no supersized manufacturing equipment, being low in manufacturing costs, maintaining a high manufacturing yield, and having a large screen and high resolution, and plasma display apparatus 63 having plasma display panel 21 therein.

When the divisional exposure method described above is implemented to form each of the components of plasma display panel 21 in a divisional manner, boundaries 1*b* and 2*b* corresponding to linking portions 52*c* between the plurality of divided areas adversely affect the display quality in some case. That is, when plasma display apparatus 63 is viewed, certain shapes of boundaries 1*b* and 2*b* are visible to user's eyes so as to spoil the outside appearance of plasma display apparatus 63 during turning-on or off, also adversely affecting the display quality of plasma display apparatus 63. Plasma display panel 21 of the present invention has the following configuration as illustrated in FIGS. 8A to 12.

FIGS. 8A to 12 show front panel 1 that can be used for plasma display panel 21 of the present invention.

On front panel 1, boundary 1*b* lies in a direction intersecting display electrodes 62 composed of scan electrode 4 and sustain electrode 5 (e.g., in a direction of arrow Y) nearly at the centers of the long side of front panel 1. Profiles of scan electrode 4 and sustain electrode 5, which have been formed separately in the respective divided areas, have unevenesses at boundary 1*b* between the plurality of divided areas. Likewise, profiles of light-shielding layer 13, which have been formed separately in the respective divided areas, have unevenesses at boundary 1*b* between the plurality of divided areas. The description below will be given with reference to figures on a configuration where the plurality of divided areas are right and left two areas. The plurality of divided areas are not restricted to the right and left two areas, but may be four areas where each of the right and left two areas is further divided into two areas, eight areas, three areas, or five areas. There is no limitation to either a number or an interval of the division.

Figure 8A:
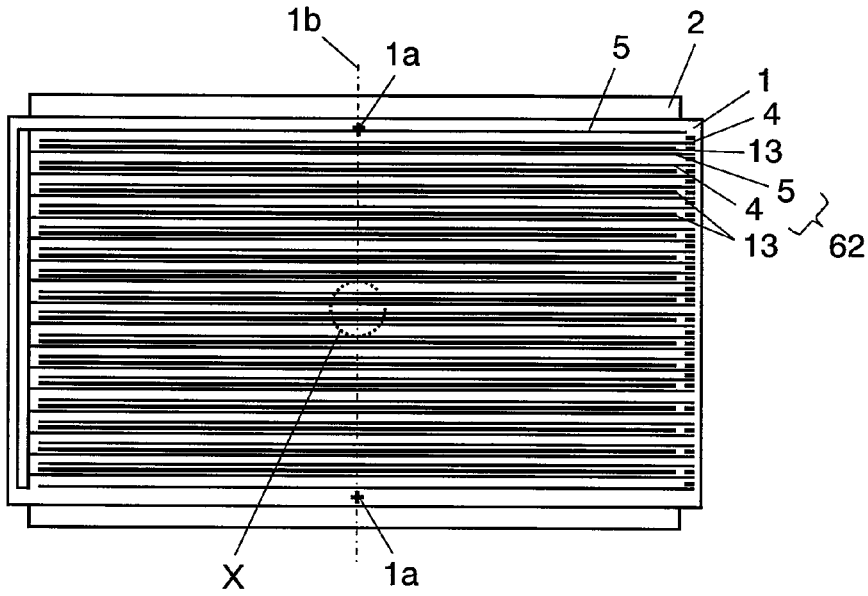
FIG. 8A is a schematic plan view showing the plasma display panel shown in FIG. 1 viewed from its front panel.
Figure 8B:
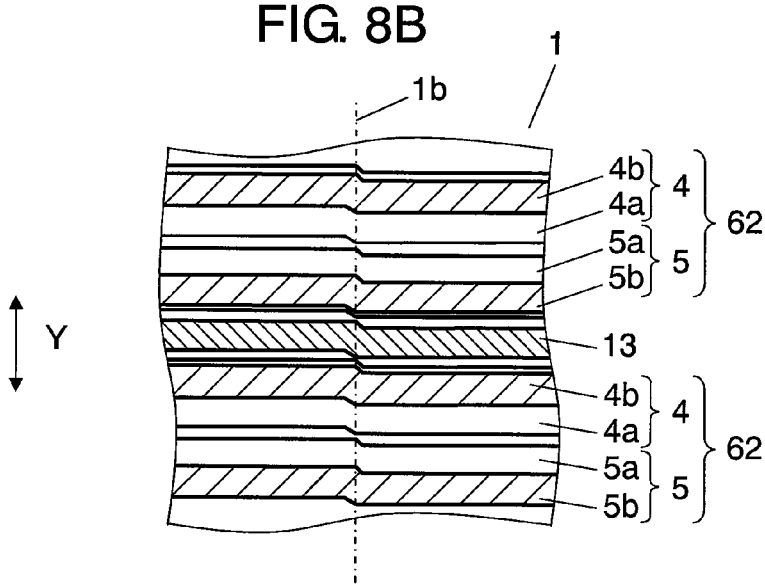
FIG. 8B is a partial enlarged plan view showing an essential part of a front panel used for the plasma display panel shown in FIG. 8A.

In an example of front panel 1 shown in FIGS. 8A and 8B, scan electrode 4, sustain electrode 5 and light-shielding layer 13 have profiles are bent at boundary 1*b* so as to be displaced in direction Y between the right and left areas divided by boundary 1*b*. Direction Y intersects display electrodes 62. FIG. 8B is a partial enlarged plan view showing an essential part X shown in FIG. 8A, where part X is almost a central part of front panel 1.

Figure 9:
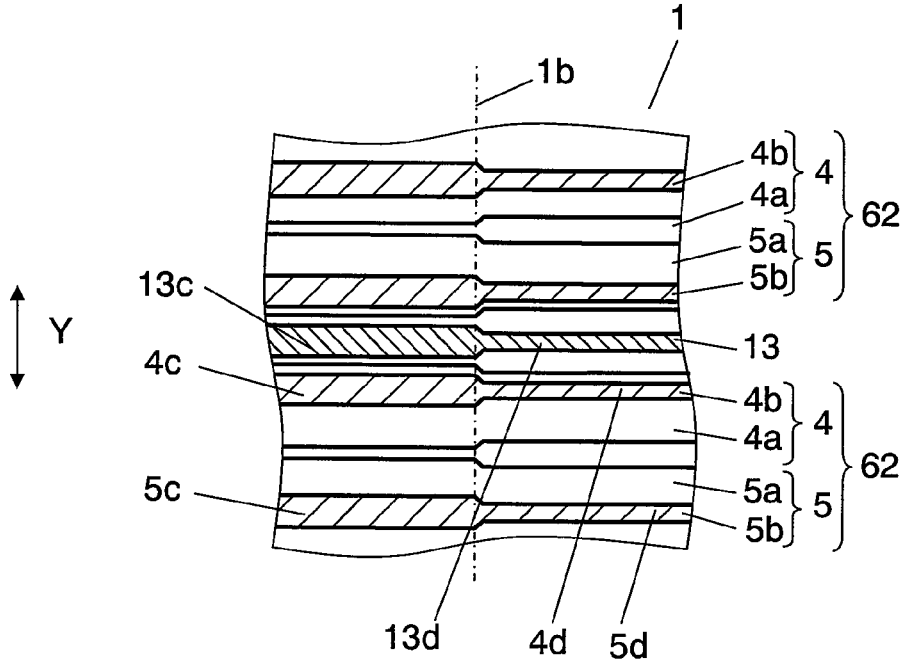
FIG. 9 is a partial enlarged plan view showing an essential part of a front panel according to another exemplary embodiment used for the plasma display panel shown in FIG. 1.

In an example of front panel 1 shown in FIG. 9, scan electrode 4, sustain electrode 5 and light-shielding layer 13 have profiles that vary in width at boundary 1*b* so as to differ in width between the right and left areas divided by boundary 1*b*. That is, scan electrode 4*d*, sustain electrode 5*d* and light-shielding layer 13*d* lying to the right of boundary 1*b* are narrower than scan electrode 4*c*, sustain electrode 5*c* and light-shielding layer 13*c* lying to the left of boundary 1*b*, respectively. Scan electrode 4*d*, sustain electrode 5*d* and light-shielding layer 13*d* may, inversely, be broader than scan electrode 4*c*, sustain electrode 5*c* and light-shielding layer 13*c*, respectively. Alternatively, scan electrode 4*d* and sustain electrode 5*d* may be narrower than scan electrode 4*c* and sustain electrode 5*c*, respectively, whereas light-shielding layer 13*d* may be broader than light-shielding layer 13*c*, although shown in no figure.

Figure 10:
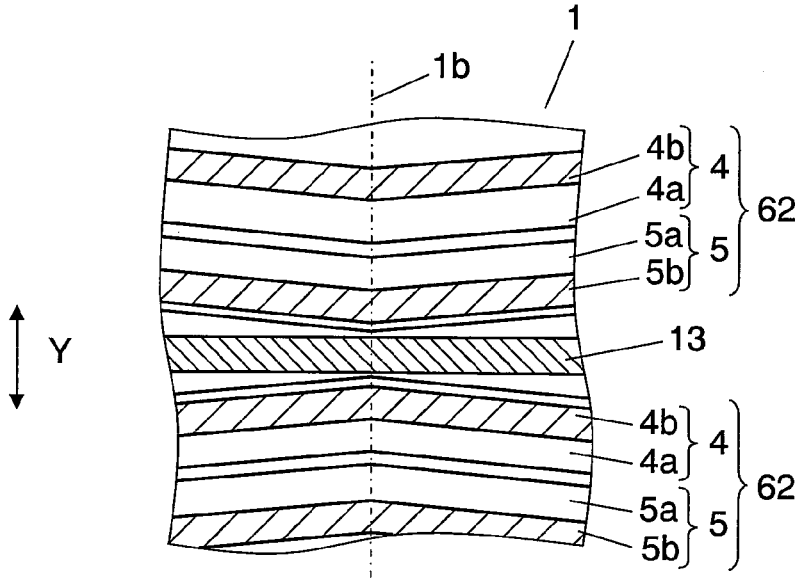
FIG. 10 is a partial enlarged plan view showing an essential part of a front panel according to still another exemplary embodiment used for the plasma display panel shown in FIG. 1.
Figure 11:
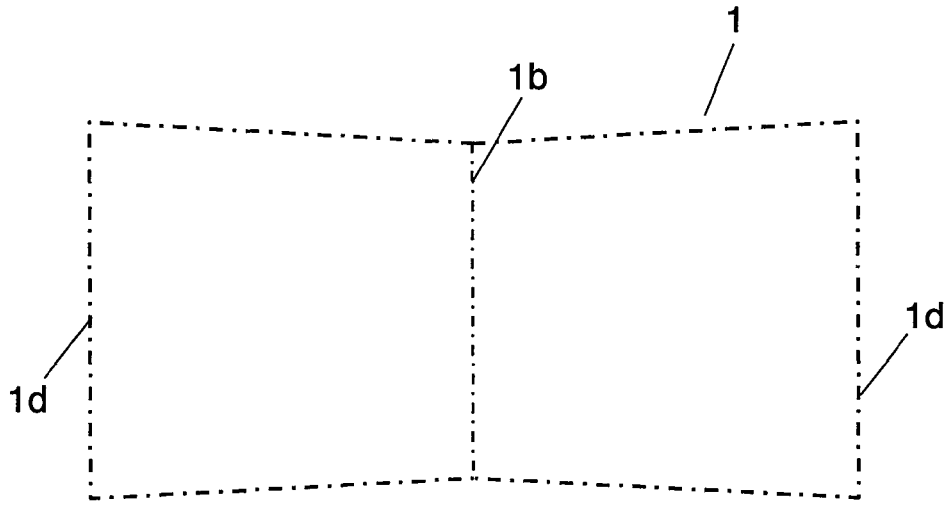
FIG. 11 is a schematic explanatory view showing a front panel used for the plasma display panel shown in FIG. 1.

In an example of front panel 1 shown in FIG. 10, scan electrode 4, sustain electrode 5 and light-shielding layer 13 are inclined outwardly nearly from the center of boundary 1*b* at the respective right and left areas divided by boundary 1*b*. Therefore, as shown in FIG. 11, the components are formed in such patterns where side edges 1*d* of front panel 1 are longer than boundary 1*b* provided substantially at the center of front panel 1.

Figure 12:
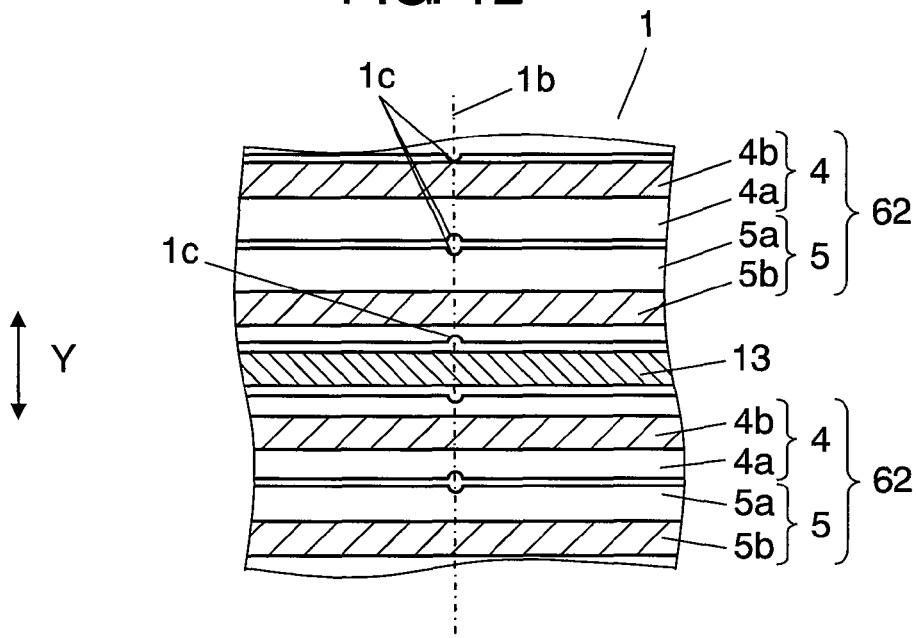
FIG. 12 is a partial enlarged plan view showing an essential part of a front panel according to still another exemplary embodiment used for the plasma display panel shown in FIG. 1.

In an example of front panel 1 shown in FIG. 12, the profiles of the components have recesses 1*c* at boundary 1*b* between the plurality of divided areas so that transparent electrodes 4*a* and 5*a* of respective scan electrode 4 and sustain electrode 5 are narrow at boundary 1*b*.

As described above, when front panel 1 of plasma display panel 21 is formed by use of the divisional exposure method, boundary 1*b* is provided in the direction intersecting display electrodes 62 composed of scan electrode 4 and sustain electrode 5 (e.g., in the direction of arrow Y) substantially at the center of the long side of front panel 1. Besides, the profiles of scan electrode 4, sustain electrode 5 and light-shielding layer 13, which have been formed separately in the respective divided areas, have unevenesses to preset extents in their profiles at boundary 1*b* between the plurality of divided areas. By this configuration, boundary 1*b* is hardly visible to user's eyes when plasma display apparatus 63 is viewed, so that plasma display panel 21 maintaining certain display quality is easily provided. Further, plasma display apparatus 63, provided with plasma display panel 21 and having a large screen and high resolution, is easily provided.

Although detailed description has been omitted, the following should be noted. When the plurality of divided areas are not the right and left two areas but rather three areas, four areas, five areas or eight areas, for example, boundary 1*b* is provided between the divided areas if desired.

INDUSTRIAL APPLICABILITY

The plasma display panel according to the present invention provides a plasma display panel having a large screen and high resolution in a simple method, and therefore, the panel is useful for composing a display device, such as a plasma display apparatus having a large screen.

The invention claimed is:

1. A plasma display panel, comprising:

a front panel, including:

a front substrate;

a pair of alignment marks; and a plurality of display electrodes disposed on the front substrate, and each of the display electrodes composed of a first electrode and a second electrode opposing each other with a discharge gap therebetween, and a rear panel, including:

a rear substrate facing the front substrate to form a discharge space therebetween;

a barrier rib disposed on the rear substrate to divide the discharge space;

a data electrode disposed between the barrier ribs so as to intersect the plurality of display electrodes; and a phosphor layer disposed between the barrier ribs, wherein the plurality of display electrodes are formed at a plurality of divided areas separately, the plurality of divided areas being areas that the front substrate is divided into by a boundary intersecting the plurality of display electrodes, the boundary extending from one of the pair of alignment marks to the other of the pair of alignment marks, and each of the plurality of display electrodes formed in the plurality of divided areas has a discontinuity formed only at the boundary between the plurality of divided areas, the discontinuity comprising one of a change in a width of each of the electrodes and a change in a direction of an edge of each of the electrodes.

2. The plasma display panel according to claim 1, wherein the plurality of display electrodes are bent at the boundary so as to be displaced in a direction intersecting the plurality of display electrodes between the plurality of areas divided by the boundary.

3. The plasma display panel according to claim 1, wherein the plurality of display electrodes vary in width at the boundary so as to differ in width between the plurality of areas divided by the boundary.

4. The plasma display panel according to claim 1, wherein the boundary is provided substantially at a center of the front panel, and the plurality of display electrodes have patterns inclined outwardly from the boundary at respective right and left areas divided by the boundary.

5. A plasma display panel, comprising:

a front panel, including:

a front substrate;

a pair of alignment marks;

a plurality of display electrodes disposed on the front substrate, and each of the display electrodes composed of a first electrode and a second electrode opposing each other with a discharge gap therebetween; and a light-shielding layer disposed between the plurality of display electrodes, and a rear panel, including:

a rear substrate facing the front substrate to form a discharge space therebetween;

a barrier rib disposed on the rear substrate to divide the discharge space;

a data electrode disposed between the barrier ribs so as to intersect the plurality of display electrodes; and a phosphor layer disposed between the barrier ribs, wherein the light-shielding layer is formed at a plurality of divided areas separately, the plurality of divided areas being areas that the front substrate is divided into by a boundary intersecting the plurality of display electrodes, the boundary extending from one of the pair of alignment marks to the other of the pair of alignment marks, and the light-shielding layer formed in the plurality of divided areas has a discontinuity formed only at the boundary between the plurality of divided areas.

6. The plasma display panel according to claim 5, wherein the light-shielding layer is bent at the boundary so as to be displaced in a direction intersecting the plurality of display electrodes between the plurality of areas divided by the boundary.

7. The plasma display panel according to claim 5, wherein the light-shielding layer varies in width at the boundary so as to differ in width between the plurality of areas divided by the boundary.

8. The plasma display panel according to claim 5, wherein the boundary is provided substantially at a center of the front panel, and the light-shielding layer has a pattern inclined outwardly from the boundary at respective right and left areas divided by the boundary.

9. A plasma display panel, comprising:

a front panel, including:

a front substrate;

a pair of alignment marks, the pair of alignment marks defining a boundary extending from one of the pair of alignment marks to the other of the pair of alignment marks; and a plurality of display electrodes disposed on the front substrate, the plurality of display electrodes each having a first portion with a first electrode width, a second portion with a second electrode width, and a transition portion formed only at the boundary and extending from the first portion to the second portion, wherein an edge of the transition portion extends in a different direction than the edges of the first portion and the second portion that are continuous with the edge of the transition portion; and the width of the transition portion is smaller than at least one of a) the width of the first portion or b) the width of the second portion;

each of the display electrodes composed of a first electrode and a second electrode opposing each other with a discharge gap therebetween, and a rear panel, including:

a rear substrate facing the front substrate to form a discharge space therebetween;

a barrier rib disposed on the rear substrate to divide the discharge space;

a data electrode disposed between the barrier ribs so as to intersect the plurality of display electrodes; and a phosphor layer disposed between the barrier ribs.

* * * * *